US008015923B2

(12) United States Patent
Caillaut

(10) Patent No.: US 8,015,923 B2
(45) Date of Patent: Sep. 13, 2011

(54) LARGE CALIBRE AMMUNITION LOADED VIA REAR

(75) Inventor: Nicolas Caillaut, Sainte Solange (FR)

(73) Assignee: Nexter Munitions, Versailles (FR)

( * ) Notice: Subject to any disclaimer, the term of this patent is extended or adjusted under 35 U.S.C. 154(b) by 222 days.

(21) Appl. No.: 12/385,302

(22) Filed: Apr. 3, 2009

(65) Prior Publication Data

US 2010/0071578 A1 Mar. 25, 2010

(30) Foreign Application Priority Data

Apr. 9, 2008 (FR) ..... 08 01943

(51) Int. Cl.
*F42B 5/18* (2006.01)

(52) U.S. Cl. ..... 102/431; 102/432

(58) Field of Classification Search ..... 42/431, 42/432, 469

See application file for complete search history.

(56) References Cited

U.S. PATENT DOCUMENTS

| | | | | | |
|---|---|---|---|---|---|
| 189,069 | A * | 4/1877 | Smith | 102/469 |
| 498,856 | A * | 6/1893 | Overbaugh | 102/469 |
| 546,936 | A * | 9/1895 | Pinfold | 102/469 |
| 1,002,038 | A * | 8/1911 | Clyne | 102/470 |
| 3,590,740 | A * | 7/1971 | Herter | 102/466 |
| 3,732,821 | A * | 5/1973 | Royer | 102/431 |
| 4,187,271 | A * | 2/1980 | Rolston et al. | 264/258 |
| 4,202,270 | A * | 5/1980 | Luther et al. | 102/464 |
| 4,938,145 | A * | 7/1990 | Martwick | 102/434 |
| 4,938,146 | A * | 7/1990 | Gunther et al. | 102/439 |
| 5,069,137 | A * | 12/1991 | Martwick | 102/434 |
| 5,747,723 | A * | 5/1998 | Buckalew et al. | 102/282 |
| 5,834,681 | A * | 11/1998 | DuBay | 102/430 |
| 6,101,950 | A * | 8/2000 | Kothe | 102/530 |
| 6,343,552 | B1 * | 2/2002 | Harris | 102/282 |
| 2005/0115445 | A1 * | 6/2005 | Reynolds | 102/469 |
| 2010/0071578 | A1 * | 3/2010 | Caillaut | 102/431 |

FOREIGN PATENT DOCUMENTS

| | | |
|---|---|---|
| EP | 1 092 939 A1 | 4/2001 |
| EP | 1 586 852 A1 | 10/2005 |
| FR | 2 799 831 A1 | 4/2001 |
| GB | 1 338 921 | 11/1973 |

* cited by examiner

*Primary Examiner* — Bret Hayes
(74) *Attorney, Agent, or Firm* — Oliff & Berridge, PLC

(57) ABSTRACT

An ammunition comprising a projectile attached to a combustible skirt and enclosed by a base, a linking dome being provided between the skirt and the base, wherein the linking dome includes a first outer wall contacting with the skirt and a second outer wall extending from the first one and contacting with the base, and wherein the dome comprises a unit to ensure its joining with the skirt, the unit being able to be bent back by the base onto an outer wall of the combustible skirt when the base is disposed over the linking dome.

12 Claims, 3 Drawing Sheets

LARGE CALIBRE AMMUNITION LOADED VIA REAR

BACKGROUND OF THE INVENTION

1. Field of Invention

The technical scope of the present invention is that of large caliber ammunition for tank cannons and which incorporate a combustible casing or skirt that is loaded with explosive powder via the rear of the casing.

2. Description of Related Art

Ammunition comprising a combustible skirt is well known. The combustible skirt or casing carries a projectile at its front part and its closed at its other end by a metallic base.

Thus, patent FR-A-2799831 discloses ammunition of this type in which the combustible skirt is attached to a dome by rivets, the dome being capped by the base. Attachment means are provided between the dome and base. One major disadvantage of this ammunition lies in the organizational complexity of the assembly which requires numerous handling operations. Another disadvantage lies in the risk of the connecting rivets between the skirt and the dome becoming detached.

SUMMARY OF THE INVENTION

The aim of the present invention is to supply ammunition that can be loaded from the rear and which incorporates means enabling the base to be attached simply but which provide great resistance when this ammunition is subjected to traction or torsion stresses.

The invention thus relates to large caliber ammunition constituted by a projectile attached to a combustible skirt and closed by a base, a linking dome being provided between the skirt and the base, wherein the linking dome incorporates a first lateral wall cooperating with the skirt and a second lateral wall extending the first one and cooperating with the base, and wherein said dome comprises means to ensure its joining with the skirt, such means being able to be bent back by the base onto the lateral wall of the combustible skirt.

According to one characteristic of the invention, the linking means are fastened at the junction between the first and second lateral walls.

Advantageously, the linking means are constituted by flexible tabs.

According to another characteristic of the invention, the flexible tabs are provided with ridges enabling the dome to be immobilized on the skirt.

Advantageously, the tabs are part of the dome.

According to a variant embodiment, the tabs are attached to the dome by attachment means.

According to another characteristic of the invention, the dome incorporates a central ring integral with the lateral walls by arms, said ring having a drill hole to accommodate an igniter.

According to another characteristic of the invention, the arms are in the shape of convex-curved arcs fitted with means to centre the base.

According to another characteristic of the invention, the centering means are constituted by bosses intended to cooperate with matching notches in the base.

According to another characteristic of the invention, the igniter is held in the drill hole on one side by a system of snugs/notches and on the other by an elastic ring.

Advantageously, the igniter is linked to the base by a nut.

A first advantage of the ammunition according to the invention lies in the simplification of its manufacture, which only requires simple handling operations that do not require specific qualifications.

Another advantage lies in the resistance obtained for the skirt/dome/base link.

Another advantage lies in the fact that the assembly requires no mounting rivets.

BRIEF DESCRIPTION OF THE DRAWINGS

Other characteristics, particulars and advantages of the invention will become more apparent from the following description given by way of illustration and with reference to the drawings, in which.

DETAILED DESCRIPTION OF PREFERRED EMBODIMENTS

As emerges from the above, large caliber ammunition for tank cannon comprises a projectile (not shown in the Figures), integral with a combustible skirt enclosing a propellant charge. A base closes the combustible skirt at its rear part and enables it to be fired from a gun. This type of ammunition is intended to be fired from a tank cannon. To introduce the load into the combustible skirt, different devices have been imagined, and the invention relates to the use of an intermediate dome between the skirt and the metallic base of the ammunition.

The remainder of the description will focus on the joining of the combustible skirt, the dome and the base, the other elements and manufacturing processes of the ammunition being well known to some skilled in the art.

Figure 1:
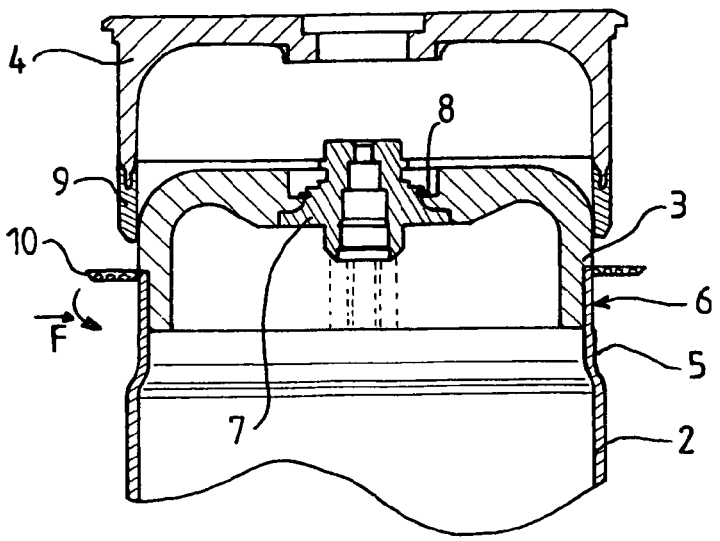
FIG. 1 shows a section of the rear end of a piece of ammunition.

This is why FIG. 1 features a section of the rear part of a piece of ammunition 1 incorporating a combustible skirt 2, a dome 3 and a base 4. The skirt 2 is combustible and classically formed of cardboard impregnated with nitrocellulose. The dome 3 is a part made of a plastic material and the base 4 is a solid metallic part.

The skirt 2 is provided with two successive narrowed sections 5 and 6 whose function will be explained hereafter. The dome 3 is fitted with an igniter 7 held by an elastic ring 8 which engages in a groove made in the dome. The dome comprises linking means 10 cooperating with the skirt and base. The base 4 is provided with a lip 9 (for example made of rubber) that is intended to ensure sealing during the ignition of the load after firing from the cannon.

Figure 2:
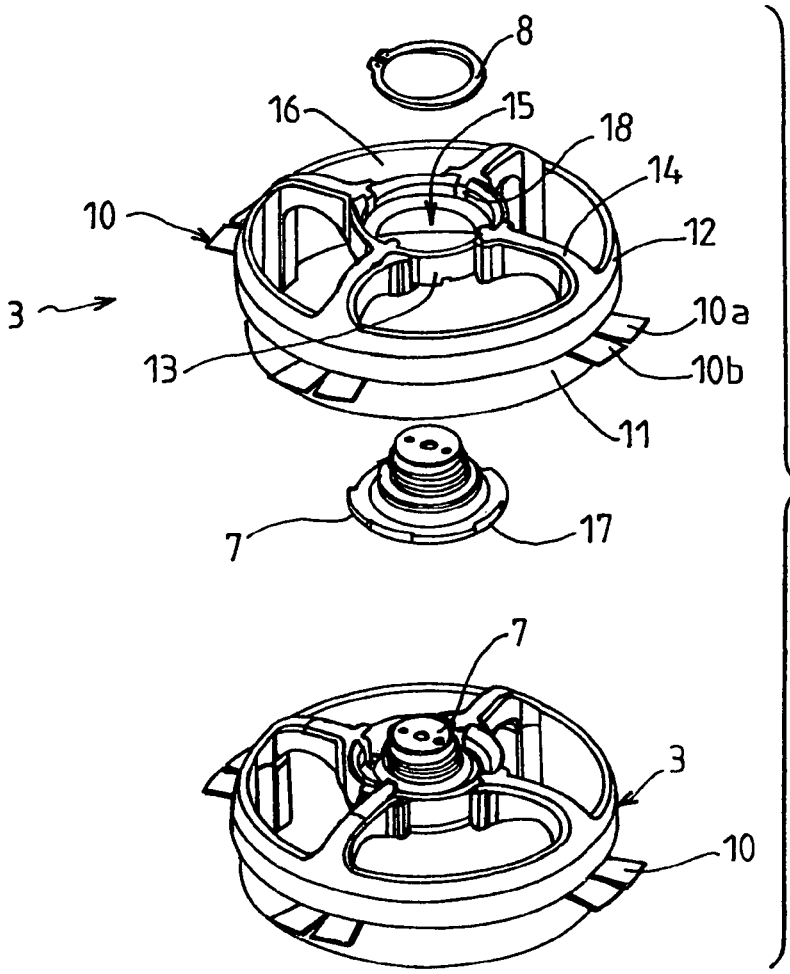
FIG. 2 shows the two phases to mount the igniter on the dome.

FIG. 2 shows an exploded view of the dome 3 and an assembled view. The dome 3 incorporates a first lateral wall intended to cooperate with the skirt 2 and a second lateral wall 12 extending the first one and intended to cooperate with the base 4. The lateral wall 12 has an external diameter that is slightly greater than that of the wall 11 so as to form a limit stop for the skirt 2. The dome comprises linking means 10 and, in the Figure these can be seen to be attached at the junction of the first 11 and second 12 lateral walls.

The linking means 10 are either integrated into the dome when this is being manufactured, or are attached to it by any means, such as for example, bonding. These are in the form of flexible tabs 10*a* and 10*b*. In an advantageous embodiment, four pairs of tabs can be provided evenly spaced around the external wall of the dome.

The dome 3 incorporates a central ring 13 integral with the lateral wall 11, 12 by arms 14. The ring 13 has a drill hole 15 to accommodate the igniter 7. The arms 14 are in the form of convex curved arcs each provided with means to centre the base 4. These centering means are constituted by bosses 18 intended to cooperate with matching notches 19 made in the base 4 (and can be seen in FIG. 3). The free space 16 between each arm 14 enables the powder forming the load to be introduced. Once again, the igniter 7 can be seen to be provided with notches 17 intended to cooperate with the dome 3 during its attachment.

The exploded view shows the initial position of the igniter 7 of the dome 3 and the elastic ring 8. The assembled view 7 shows the attachment of the igniter 7 in the drill hole 15 in the dome being attached by the elastic ring 8 pressing on a shoulder of the drill hole 15. Thus, the igniter 7 is rigidly attached to the dome 3. The igniter 7 can be seen after attachment to have a threaded part which protrudes with respect to the dome.

Figure 3:
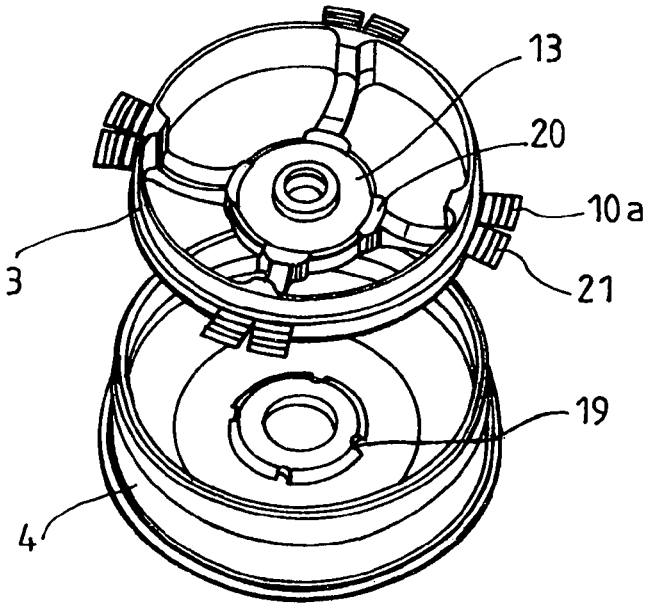
FIG. 3 shows a view illustrating the positioning of the dome with respect to the base.

FIG. 3 shows the dome 3 directly above the base 4. This view firstly enables part of the linking means of the dome 3 and base 4 and secondly part of the linking means with the igniter to be seen. The base 4 is provided with notches 19 in which the bosses 18 (visible in FIG. 2) are engaged. The introduction of these bosses in the notches 19 enables the base 4 and dome 3 to be made integral in rotation. FIG. 3 further shows that the dome 3 is provided with snugs 20 level with the central ring 13 that engage the notches 17 in the igniter 7 thereby ensuring an immobilization in rotation of this igniter with respect to the dome 3.

FIG. 3 shows that the tabs 10 are provided with ridges 21 intended to hook onto the skirt 2 during assembly.

Figure 4:
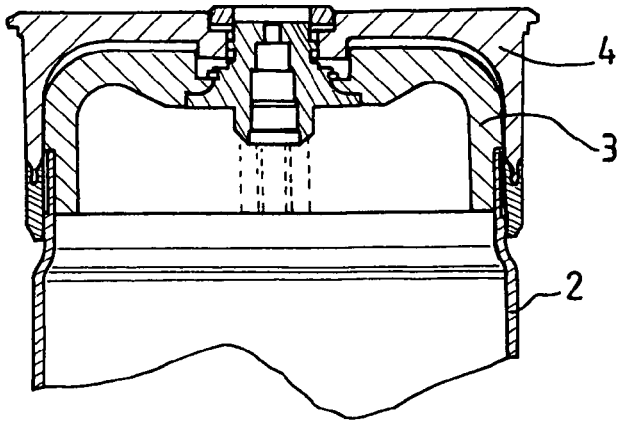
FIGS. 4 and 5 are sections of the rear part of a piece of ammunition showing the intermediate and final positioning of the ammunition elements.

FIG. 4 shows a section illustrating an intermediate phase in the assembly of the three elements. The dome 3, assembled with the igniter as shown in FIG. 2, is introduced into the skirt 2. The skirt 2 is positioned at wall 11 and thus buts against the edge of wall 12. The base 4 caps the dome 3 causing the tabs 10*a*, 10*b* to be pressed against the narrowed part 6 of the skirt. The ridges 21 on the tabs ensure that the dome 3 is held on the skirt 2. Once they have been pressed down, the tabs 10 are arranged so as not to cause extra thickness with respect to the profile of the narrowed part 5 of the skirt.

Figure 5:
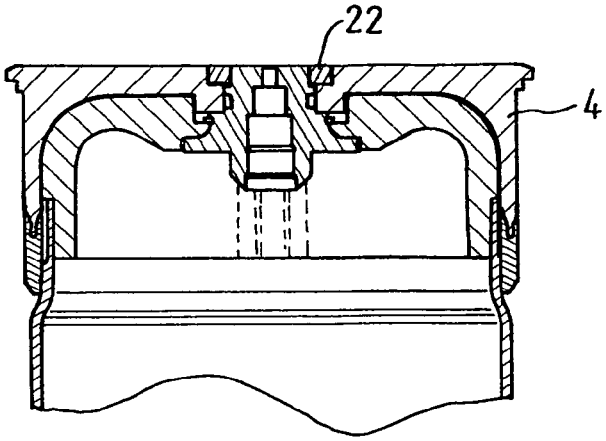

FIG. 5 shows the final position of the three elements where the base 4 can be seen to be pressing closely on the dome 3. The base 4 can be seen to be joined to the dome 3 by means of the igniter 7 and the net 22 also ensures that the skirt 2 is pinched between the dome 3 and the tabs 10. The dome 3 is thus joined to the skirt 4, effectively making the skirt, the dome and the base integral with one another.

As can be seen, this structure improves the skirt's loadability and simplifies the integration of the ammunition during the casing process.

Figures 6, 7, 8:
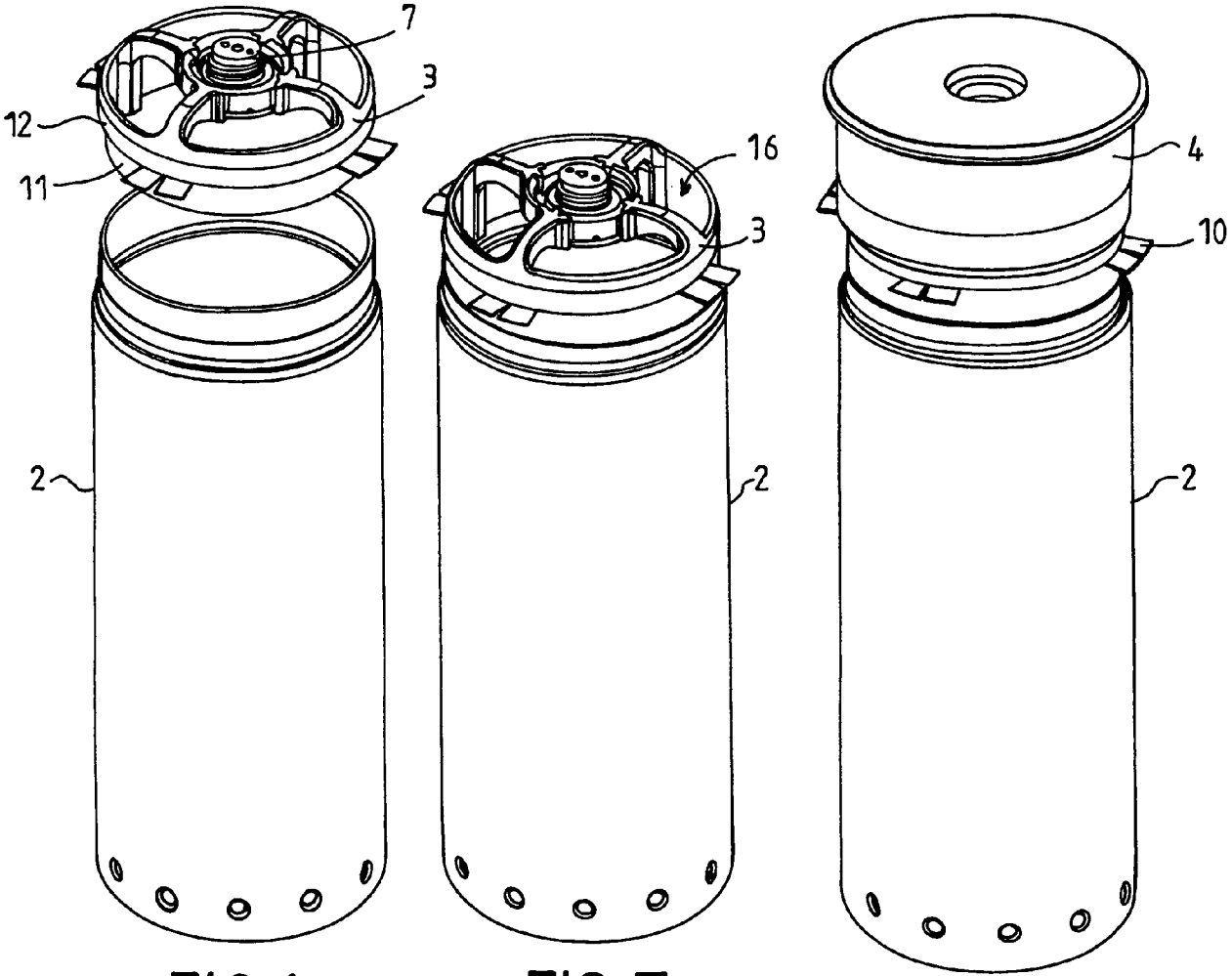
FIGS. 6 and 7 are views to illustrate the dome being set into position on the combustible skirt.
FIG. 8 is a view showing the positioning of the base on the dome.

For the manufacture of the ammunition, reference will be made to FIGS. 6 to 8. After having set the igniter 7 into position in the dome, as explained with reference to FIG. 2, the dome is placed above the skirt 2 as can be seen in FIG. 6. The dome 3 is inserted by sliding the wall 11 in the skirt until it buts against wall 12, as can be seen in FIG. 7. The propellant charge powder may then be introduced via one of the free spaces 16 at the rear of the loading dome. At the end of this loading operation, the base 4 is set into position, as can be seen in FIG. 8, until it presses against the tabs 10. Naturally, the grooves 19 are made to lie opposite the bosses 18. A further pressure is applied to the base 4 so as to fold the ridged tabs 10, thanks to the base, right back against the external surface of the skirt 2. The base 4 is pushed in until the threaded part of the igniter 7 protrudes with respect to the base. The nut 22 (seen in FIG. 5) is then tightened to lock the assembly on the skirt.

By tightening the nut, the link is made both between the base 4 and the dome 3 and between the skirt 2 and the dome 3.

What is claimed is:

1. An ammunition comprising:

a projectile attached to a combustible skirt and enclosed by a base, a linking dome disposed between said skirt and said base, wherein said linking dome includes a first outer wall contacting with said skirt and a second outer wall extending from said first outer wall and contacting with said base, and wherein said linking dome comprises linking means to ensure the linking dome joins with said skirt, said linking means being bent back onto an outer wall of said combustible skirt when the base is disposed over the linking dome.

2. The ammunition according to claim 1, wherein said linking means is integrally formed with said linking dome and fastened at a junction between said first and second outer walls.

3. The ammunition according to claim 1, wherein said linking means comprises flexible tabs.

4. The ammunition according to claim 3, wherein said flexible tabs are provided with ridges enabling said linking dome to be secured on said skirt.

5. The ammunition according to claim 4, wherein said tabs are part of said linking dome.

6. The ammunition according to claim 4, wherein said tabs are attached to said linking dome by attachment means.

7. The ammunition according to claim 4, wherein said linking dome includes a central ring integrally formed with said first and second outer walls by arms, said ring having a drill hole to accommodate an igniter.

8. The ammunition according to claim 1, wherein said linking dome includes a central ring integrally formed with said first and second outer walls by arms, said ring having a drill hole to accommodate an igniter.

9. The ammunition according to claim 8, wherein said arms are in the shape of convex-curved arcs fitted with centering means of said base.

10. The ammunition according to claim 9, wherein said centering means comprises bosses intended to contact with matching notches in said base.

11. The ammunition according to claim 8, wherein said igniter is held in said drill hole on one side by a system of snug and notches and on the other by an elastic ring.

12. The ammunition according to claim 11, wherein said igniter is linked to said base by a nut.

* * * * *